US005138992A

United States Patent [19]

Krieger

[11] Patent Number: 5,138,992

[45] Date of Patent: Aug. 18, 1992

[54] APPARATUS FOR DISCONNECTING INDIVIDUAL CYLINDERS ON AN INTERNAL COMBUSTION ENGINE

[75] Inventor: Klaus Krieger, Affalterbach, Fed. Rep. of Germany

[73] Assignee: Robert Bosch GmbH, Stuttgart, Fed. Rep. of Germany

[21] Appl. No.: 820,829

[22] Filed: Jan. 15, 1992

[30] Foreign Application Priority Data

Feb. 16, 1991 [DE] Fed. Rep. of Germany ..... 4104791

[51] Int. Cl.[5] ..... F02B 77/00

[52] U.S. Cl. ..... 123/198 F

[58] Field of Search ..... 123/198 F

[56] References Cited

U.S. PATENT DOCUMENTS 4,413,600 11/1983 Yanagawa et al. ..... 123/198 F 4,640,291 2/1987 Matsunaga ..... 123/198 F

FOREIGN PATENT DOCUMENTS 3718714 12/1988 Fed. Rep. of Germany .

*Primary Examiner*—Noah P. Kamen

*Attorney, Agent, or Firm*—Edwin E. Greigg; Ronald E. Greigg

[57] ABSTRACT

The apparatus has a fuel injection pump with two partial suction chambers separate from one another. Fuel is delivered to the first partial suction chamber by a second feed pump. A feed pump is associated with the second partial suction chamber, and a reversing valve is disposed between the feed pump and the second partial suction chamber. To inactivate the cylinders of the engine that are associated with the second partial suction chamber, the reversing valve is reversible into a deactivation position, in which the intake side of the feed pump communicates with the second partial suction chamber and the pressure side communicates with the fuel supply tank. Fuel is thus evacuated from the second partial suction chamber by the second feed pump, so that fast inactivation of the associated cylinders is attained.

21 Claims, 5 Drawing Sheets

APPARATUS FOR DISCONNECTING INDIVIDUAL CYLINDERS ON AN INTERNAL COMBUSTION ENGINE

BACKGROUND OF THE INVENTION

The invention is based on an apparatus for disconnecting individual cylinders of an internal combustion engine as defined hereinafter.

Such an apparatus is known from German Offenlegungsschrift 37 18 714. This apparatus has a fuel injection pump, with at least two partial suction chambers, separate from one another and assigned to different cylinders of the engine. The partial suction chambers communicate with a common feed pump via separate lines. One valve is disposed in each of the lines from the feed pump to the partial suction chambers. When the valves are open, fuel is pumped into the applicable partial suction chamber by the feed pump and to the associated engine cylinders at high pressure by the fuel injection pump. By the closure of one of the valves, the applicable partial suction chamber can be inactivated from supplying fuel from the feed pump, so that no further fuel is supplied to the associated cylinders, and they merely trail along.

Although the closure of the valve does inactivate the partial suction chamber from the feed pump quickly, nevertheless the idle volume of the fuel injection pump, which under some circumstances may be considerable, means that more fuel continues to be pumped to the cylinders that are to be inactivated, so that there is a considerable delay before they are inactivated. If the cylinders are intended to be inactivated only briefly, complete inactivation cannot be achieved with the known apparatus.

OBJECT AND SUMMARY OF THE INVENTION

The apparatus according to the invention for inactivating individual cylinders of an internal combustion engine has an advantage over the prior art that in the inactivation position of the reversing valve, fuel is evacuated from the partial suction chamber associated with the inactivated cylinders by the feed pump, thus making a fast inactivation of the associated cylinders possible.

Advantageous features and further developments of the apparatus are defined hereinafter. In the case of the supply to the partial suction chambers by separate feed pumps as defined, the feed pump assigned to the partial suction chamber associated with the inactivatable cylinders can evacuate the partial suction chamber independently of the fuel supply to the other partial suction chamber. A reversing valve that is structurally simple and requires only a few additional fuel lines is recited herein. If transverse scavenging is provided for the partial suction chambers of the fuel injection, then for cylinder inactivation the feed pump can evacuate fuel from the partial suction chamber via the requisite overflow line, without a reversal of the flow direction compared with the operation of the cylinders, if the reversing valve is embodied as a 6/2-way valve as recited herein. By means of further features recited herein, all the engine cylinders can be inactivated, or in other words the engine can be stopped, with the apparatus by opening the shutoff valve and having the feed pump evacuate fuel from all the partial suction chambers. To prevent continued pumping of fuel into the partial suction chamber by the further feed pump when the engine is stopped, a further shutoff valve is advantageously provided, by means of which the partial suction chamber can be disconnected from the feed pump.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
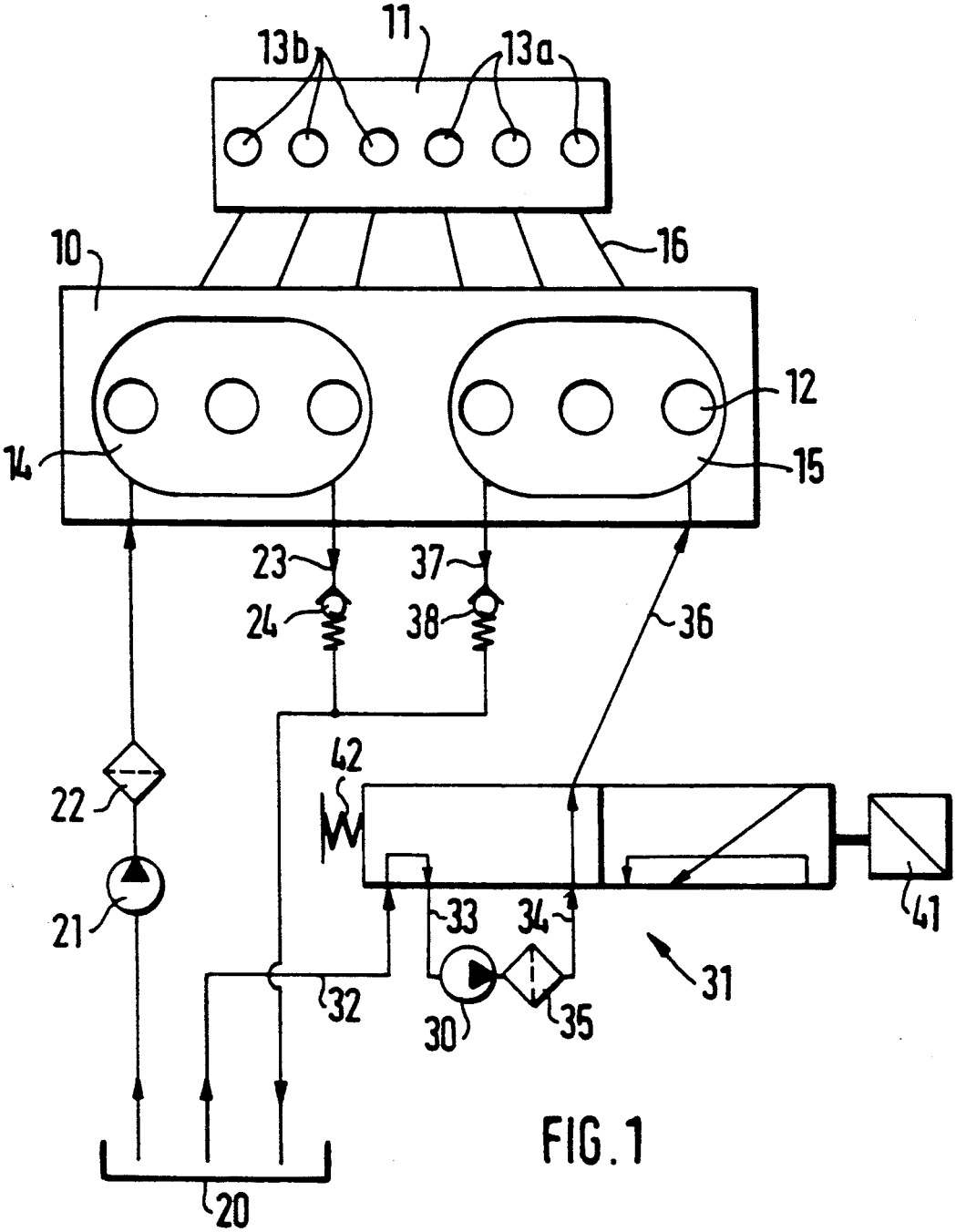
FIGS. 1 and 2 show a first exemplary embodiment of the apparatus, with the apparatus shown in a pumping position in FIG. 1 and in a position for cylinder inactivation in FIG. 2.

An apparatus for disconnecting individual cylinders of an internal combustion engine has a fuel injection pump 10 that supplies fuel to a multicylinder engine 11. The fuel injection pump is embodied as an in-line injection pump, with pump elements 12 that correspond in number to the cylinders 13*a* and 13*b* of the engine 11, and it has a plurality of partial suction chambers 14, 15, for instance two in number, which are separate from one another. A plurality of pump elements 12 aspirate fuel from one partial suction chamber 14, 15 and pump the fuel at high pressure through fuel lines 16 to the injection points at the cylinders 13*a* and 13*b* of the engine 11. By way of example, to supply a six-cylinder engine, the fuel injection pump 10 has six pump elements 12, three of which aspirate fuel from one partial suction chamber 14 and the other three from the other partial suction chamber 15.

Figure 2:
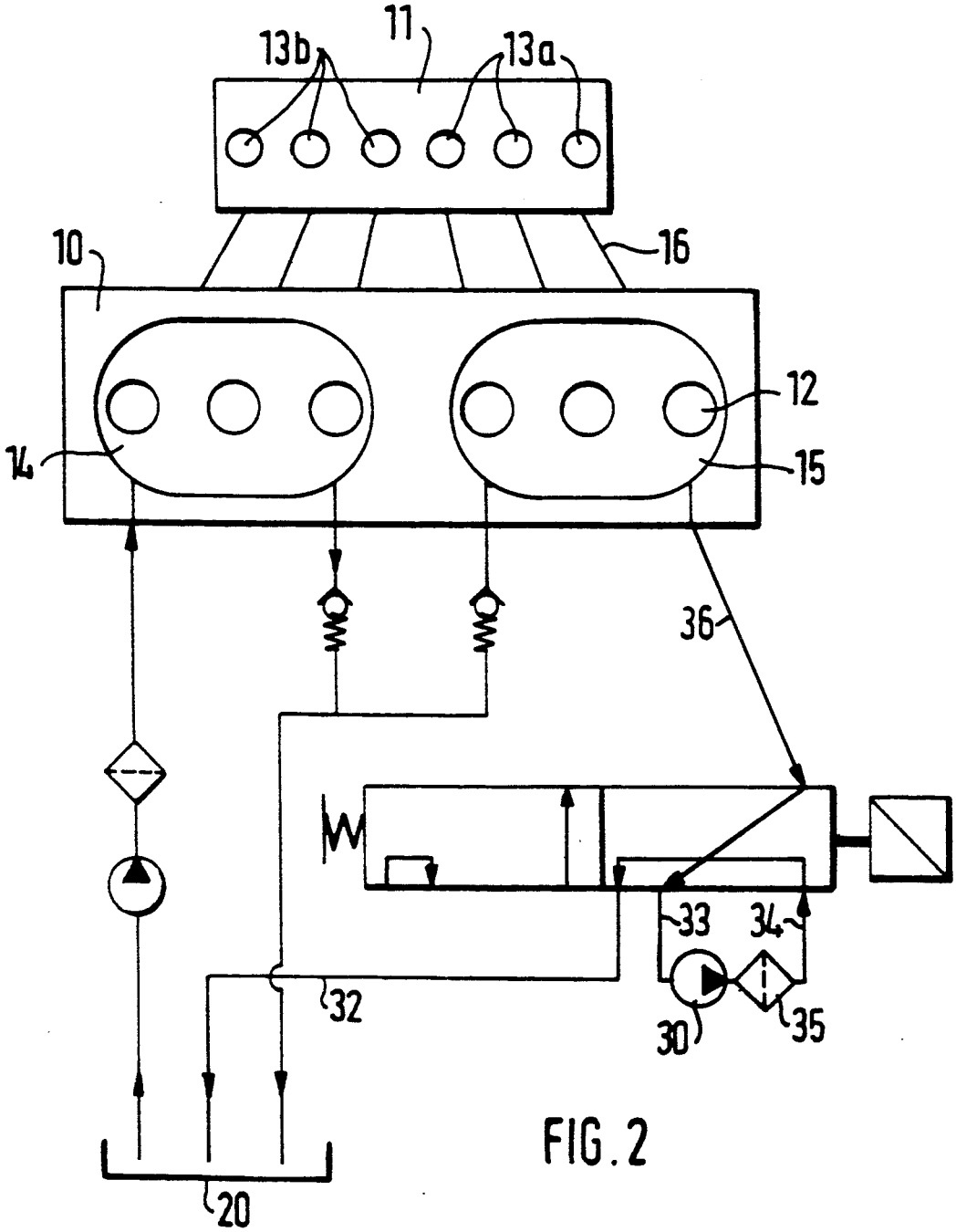

In a first exemplary embodiment shown in FIGS. 1 and 2, fuel is delivered to the first partial suction chamber 14, in the region of one of its ends, by means of a first feed pump 21 that aspirates fuel from a fuel supply tank 20. A filter 22 is disposed between the feed pump 21 and the partial suction chamber 14. An overflow line 23, which leads back to the fuel supply tank 30, and in which a one-way overflow valve 24 is disposed, leads from the first partial suction chamber 14, in the region of its other end, so that transverse scavenging of the first partial suction chamber 14 is attained. Fuel is delivered to the second partial suction chamber 15 by means of a second feed pump 30. A reversing valve 31 is incorporated into the connection between the fuel supply tank 20 and the second feed pump 30, and between the second feed pump 30 and the second partial suction chamber 15. Connected to the reversing valve 31 are a tank line 32 leading from the fuel supply tank 20, an intake line 33 leading to the intake side of the feed pump 30, a pressure line 34 that leads from the feed pump, into which a filter 35 is introduced, and a connecting line 36 leading to the region of one end of the second partial suction chamber 15. From the region of the other end of the second partial suction chamber 15, an overflow line 37 leads to the fuel supply tank 20; a one-way overflow valve 38 is disposed in the overflow line 37 which may be united with the overflow line 23 of the first partial suction chamber 14. The reversing valve 31 is embodied as a 4/2-way valve, for example with an axially movably guided valve member, not shown. The valve member is kept in a pumping position, for instance, by an electromagnet 41 counter to the force of a spring 42 and is kept in a deactivation position by the spring 42 when there is no current to the electromagnet 41.

In FIG. 1, the reversing valve 31 is shown in the pumping position, in which by means of the valve member the intake line 33 of the second feed pump 30 communicates with the tank line 32, and the pressure line 34 of the feed pump 30 communicates with the connecting line 36. Fuel is delivered to the first partial suction chamber 14 by the first feed pump 21. In the pumping position of the reversing valve 31, all the cylinders 13*a*, 13*b* of the engine 11 are thus supplied with fuel.

In the deactivation position of the reversing valve 31, shown in FIG. 2, the valve member 31 connects the intake line 33 leading to the second feed pump 30 to the connecting line 36 leading to the second partial suction chamber 15 and connects the pressure line 34 of the feed pump 30 to the tank line 32, so that the second feed pump 30 evacuates fuel from the second partial suction chamber 15 and pumps it back into the fuel supply tank 20. No further fuel is then pumped to the cylinders 13*a* of the engine 11 supplied by the pump elements 12 that aspirate from the second partial suction chamber 15, so that these cylinders merely trail along now. The deactivation of the cylinders 13*a* happens very fast, since fuel is drawn from the partial suction chamber 15 by the feed pump 30. Fuel continues to be pumped into the first partial suction chamber 14 by the feed pump 21, so that the associated cylinders 13*b* can be operated. If only a few pump elements 12 are aspirating from a partial suction chamber 14, 15, then scavenging of the partial suction chambers can be dispensed with, in which case the overflow lines 23, 34 may be omitted.

Figure 3:
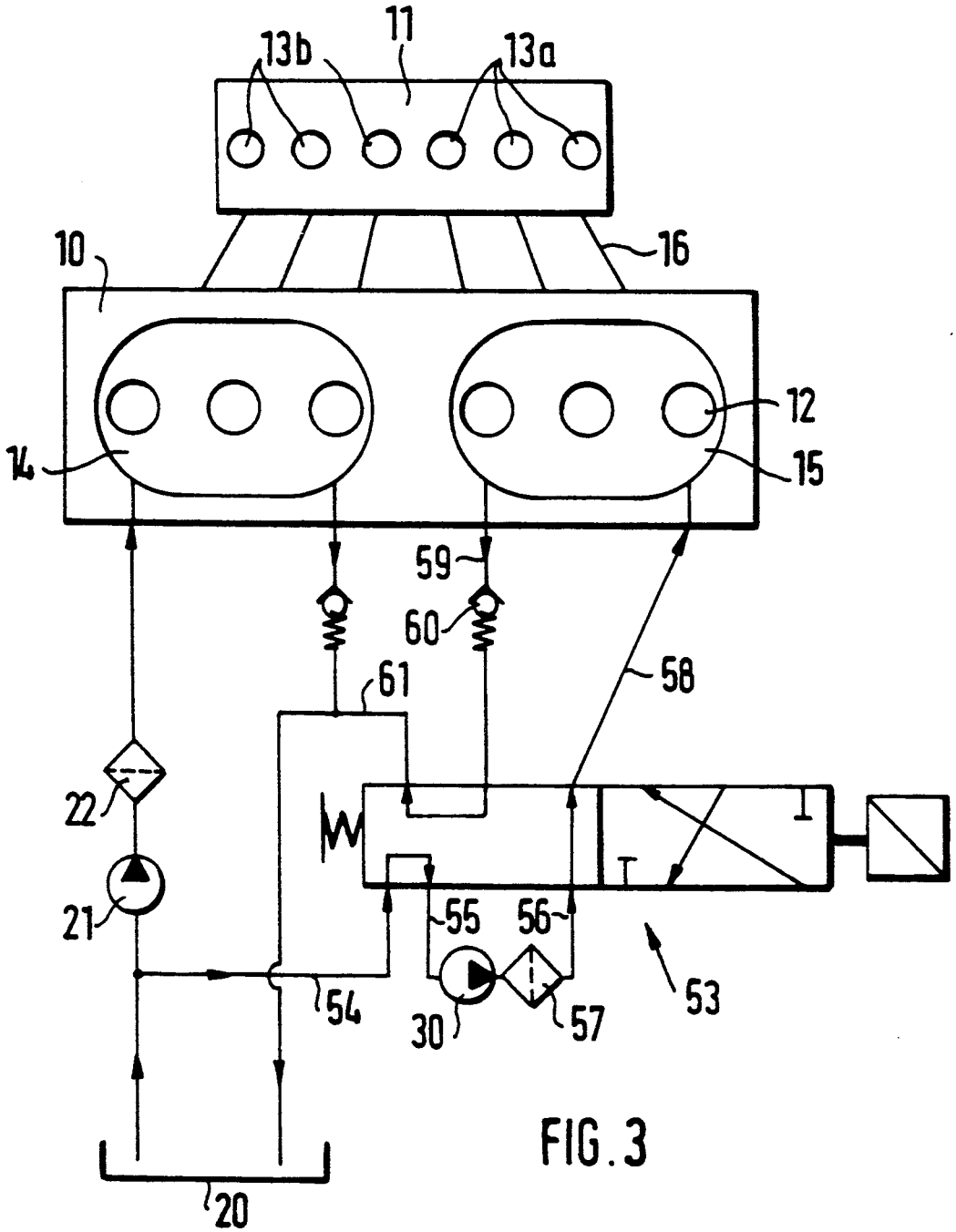
FIGS. 3 and 4 show a second exemplary embodiment of the apparatus, which in FIG. 3 is shown in a pumping position and in FIG. 4 in a position for cylinder inactivation.
Figure 4:
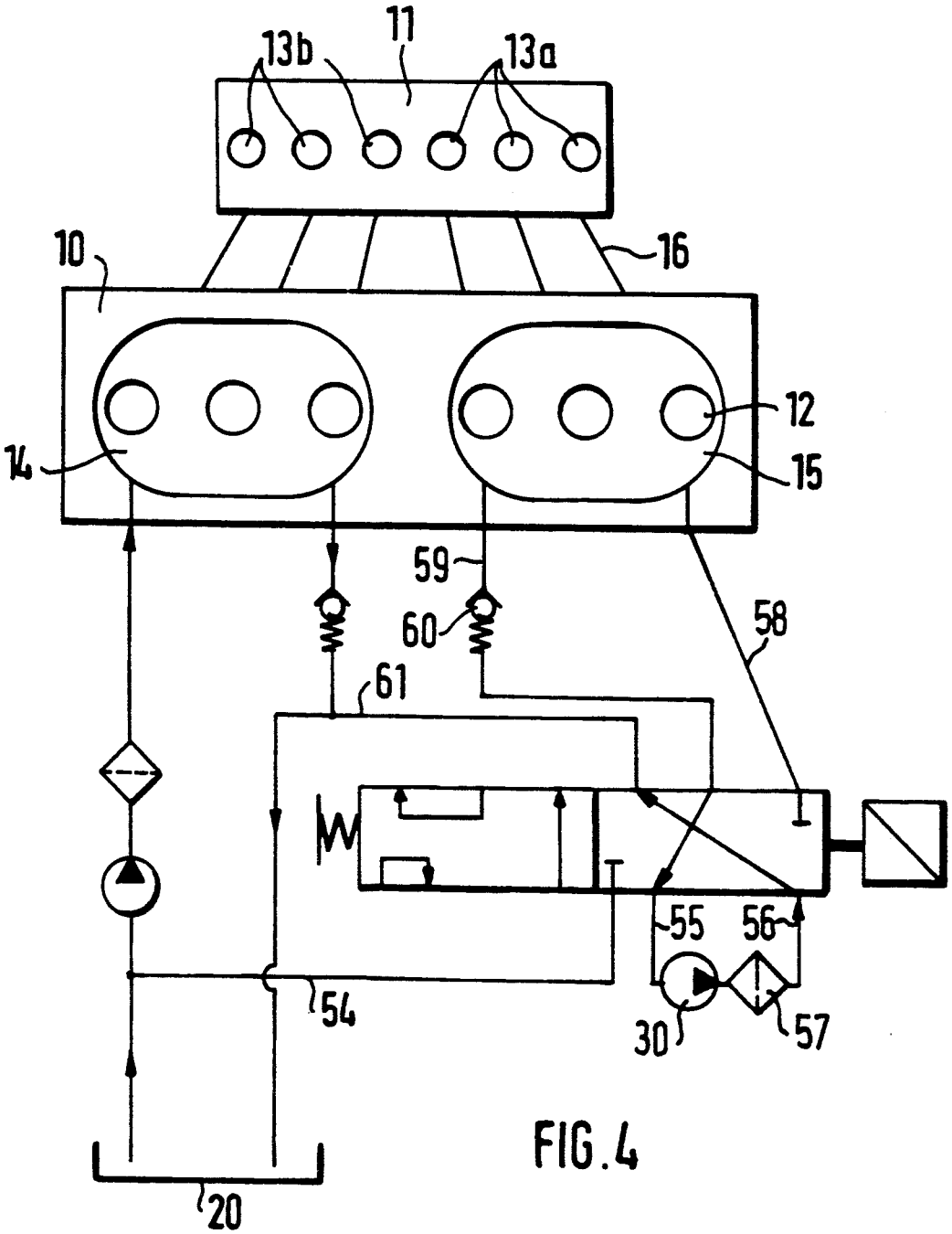

In a second exemplary embodiment, shown in FIGS. 3 and 4, the fuel injection pump 19 likewise has two partial suction chambers 14, 15. As in the first exemplary embodiment, fuel is delivered to the first partial suction chamber 14 in the region of one end by means of a first feed pump 21 that aspirates from a fuel supply tank 20. A filter 22 is disposed between the first feed pump 21 and the first partial suction chamber 14. Leading away from the first partial suction chamber 14 in the region of its other end is an overflow line 23, which leads back to the fuel supply tank 20 and in which a one-way overflow valve 24 is incorporated. Fuel is delivered to the second partial suction chamber 15 by means of a second feed pump 30. A reversing valve 53 is inserted into the connection 54, 55 between the fuel supply tank 20 and the second feed pump 30 and between the latter and the second partial suction chamber 15. Connected to the reversing valve 53 are a tank line 54 from the fuel supply tank 20, an intake line 55 to the suction side of the feed pump 30, a pressure line 56 from the feed pump, into which line a filter 57 is incorporated, a connecting line 58 leading to the region of one end of the partial suction chamber 15, an overflow line 59, leading away from the region of the other end of the partial suction chamber 15 and in which a one-way overflow valve 60 is disposed, and a return line 61 leading to the fuel supply tank 20. The tank line 54 to the reversing valve 53 can also branch off from the intake line to the first feed pump 21 of the first suction chamber 14. The overflow line 23 leading away from the first partial suction chamber 14 may be united with the return line 61 from the reversing valve 53. The reversing valve 53 is embodied as a 6/2-way valve and as in the first exemplary embodiment is embodied as a magnet valve, having an axially movable valve member, not shown.

In FIG. 3, the reversing valve 53 is shown in a pumping position, in which the intake line 55 communicates with the tank line 54 via the reversing valve 53 and the pressure line 56 communicates with the connecting line 58 via the reversing valve. The overflow line 59 from the partial suction chamber 15 communicates with the return line 61 via the reversing valve 53. Fuel is pumped into the first partial suction chamber 14 by the first feed pump 21. Excess fuel, which is not pumped by the pump elements 12, then flows out of the two partial suction chambers 14, 15, through the overflow lines 23, and 59, back to the fuel supply tank 20.

In FIG. 4, the apparatus is shown in a position for cylinder deactivation, in which the valve member of the reversing valve 53 is in a deactivation position, in which the intake line 55 of the second feed pump 30 communicates with the connecting line 58, and the pressure line 56 of the feed pump communicates with the return line 61. The second partial suction chamber 15 is aspirated until empty through the overflow line 59 via the reversing valve by the pump 30 so that compared with the pumping position of the reversing valve 53, no reversal of the flow direction in the second partial suction chamber 15 takes place. No further fuel is pumped to the cylinders 13*a* of the engine 11 that are associated with the second partial suction chamber 15, and so these cylinders are merely trailed along. The first partial suction chamber 14 continues to be supplied with fuel by the first feed pump 21, so that the associated cylinders 13*b* can continue to be operated.

Figure 5:
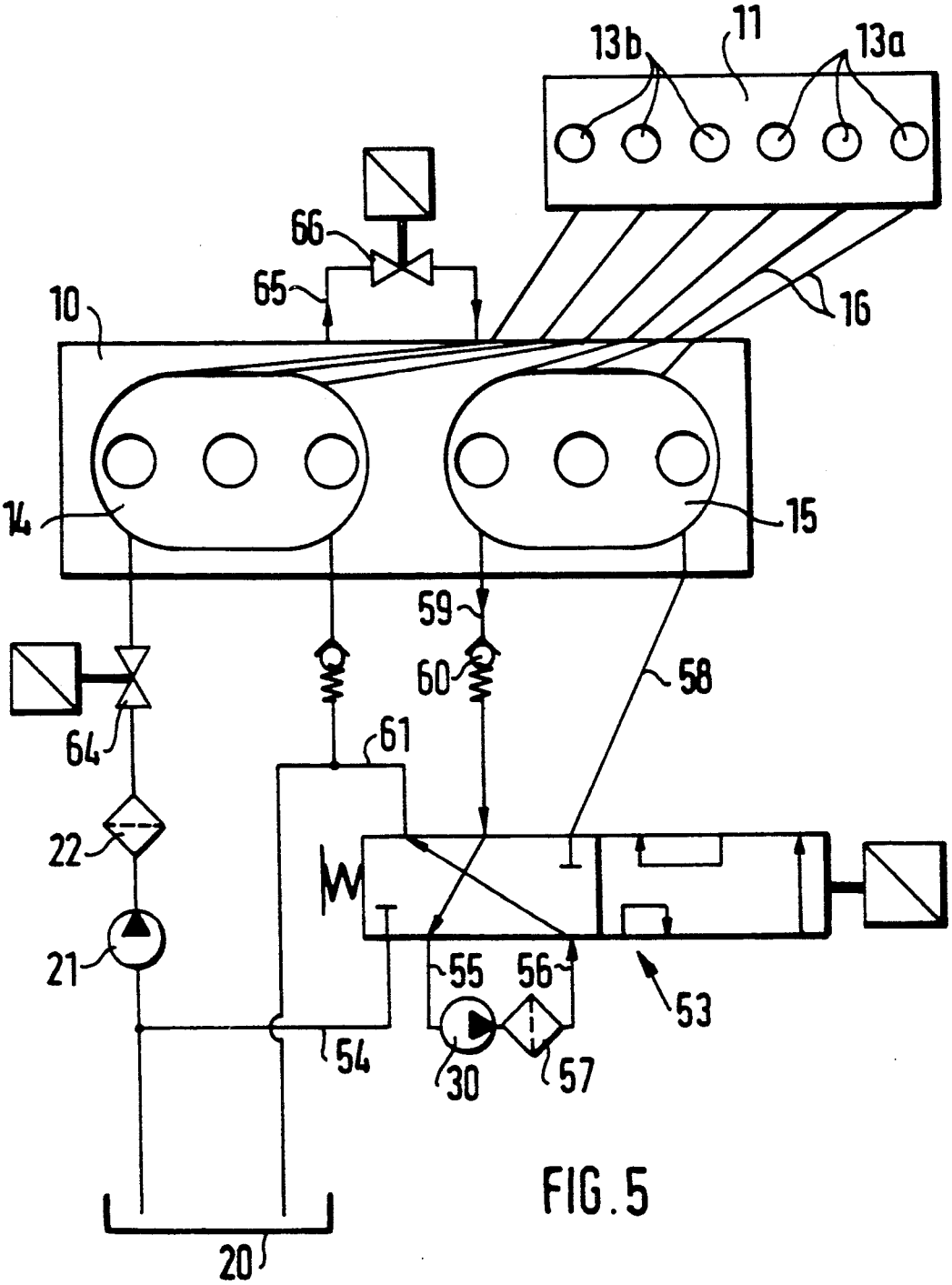
FIG. 5 shows a variant of the apparatus of FIG. 4 in a inactivation position, for turning off the engine.

FIG. 5 shows a variant of the apparatus of FIG. 4, in which a first shutoff valve 64 is disposed between the first feed pump 21 and the first partial suction chamber 14. The two partial suction chambers 14, 15 communicate with one another via a line 65, in which a second shutoff valve 66 is disposed. In this further development of the apparatus, the reversing valve 53, in its deactivation position, can be used to shut off the engine 11. For shutting off the engine, the second shutoff valve 66 is also opened, so that the two partial suction chambers 14, 15 communicate with one another and the first shutoff valve 64 is closed, so that no further fuel can be pumped into the first partial suction chamber 14. Fuel is now aspirated by the second feed pump 30 from the first partial suction chamber 14 and the second partial suction chamber 15, so that all the cylinders 13*a*, 13*b* are deactivated and the engine 11 comes to a stop. By means of the first feed pump 21, further fuel continues to be pumped until the engine 11 stops, but because of the closed first shutoff valve 64 this fuel cannot flow away to the first partial suction chamber 14. The first feed pump 21 there has an internal diversion, so that the fuel that continues to be pumped can flow back to the intake side of the feed pump or to the fuel supply tank. The further development described above can also be used in the first exemplary embodiment of the apparatus, so that the reversing valve 31 there can also be used for turning off the engine 11.

In a variant that is not shown, one reversing valve corresponding to the above-described reversing valves, may be assigned to each of the partial suction chambers 14, 15; in that case, the cylinders 13*a*, 13*b* associated with the partial suction chambers 14, 15 can be deactivated in alternation, and uniform cooling down of the cylinders is attainable.

The above-described reversing valves 31 and 53 can be actuated by an electrical control unit, not shown, which detects and evaluates such engine operating parameters as rpm, load, temperature, and so forth and actuates the reversing valve as a function of them. The shutoff valves 64 and 66 can also be actuated by the control unit in order to turn off the engine.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An apparatus for disconnecting individual cylinders of an internal combustion engine (11), having a fuel injection pump (10) that has at least two partial suction chambers (14, 15) that can be deactivated from one another and are associated with different cylinders (13*a*, 13*b*) of the engine (11), a feed pump (30) which for operation of the cylinders (13*a*) pumps fuel from a fuel supply tank (20) into the applicable partial suction chamber (15), wherein to deactivate the cylinders (13*a*) the delivery of fuel from the feed pump (30) to the applicable partial suction chamber (15) is interrupted by means of a reversing valve (31; 53) introduced between the feed pump (30) and the partial suction chamber (15), the reversing valve (31; 53), is in a pumping position for operation of the deactivatable cylinders (13*a*), the intake side of the feed pump (30) communicates with the fuel supply tank (20) and the pressure side of the feed pump (30) communicates with the partial suction chamber (15), and by means of which, in a deactivation position for deactivating the cylinders (13*a*), the intake side of the feed pump (30) is switched by the reversing valve to communicate with the partial suction chamber (15), and the pressure side of the feed pump communicates with the fuel supply tank (20).

2. An apparatus as defined by claim 1, in which the feed pump (30) having the reversing valve (31; 53) is assigned to at least one of the partial suction chambers (15), and that a second feed pump (21), which pumps fuel out of the fuel supply tank (20), is assigned to at least one of the other partial suction chambers (14).

3. An apparatus as defined by claim 2, in which the reversing valve (31; 53) is embodied as a two-position multiway valve with an electromagnetic actuation.

4. An apparatus as defined by claim 3, in which the reversing valve is embodied as a 4/2-way valve (31), wherein a tank line (32) from the fuel supply tank (20), an intake line (33) to the feed pump (30), a pressure line (34) from the feed pump, and a connecting line (36) to the partial suction chamber (15) are connected to the reversing valve, and in the pumping position, the connection of the tank line (32) to the intake line (33) and of the pressure line (34) to the connecting line (36) is open, and in the deactivation position, the connection of the connecting line (36) to the intake line (33) and of the pressure line (34) to the tank line (32) is open.

5. An apparatus as defined by claim 4, in which the partial suction chamber (14, 15) can be connected to one another, and the connection is controllable by means of a shutoff valve (66), wherein the shutoff valve (66) is closed during engine operation, and for shutting off the engine the reversing valve (31; 53) is located in the disconnection position and the shutoff valve (66) is open.

6. An apparatus as defined by claim 3, in which the reversing valve is embodied as a 6/2-way valve (53), and that an overflow line (59) leads away from the partial suction chamber (15) associated with the reversing valve, wherein a tank line (54) from the fuel supply tank (20), an intake line (55) to the feed pump (30), a pressure line (56) from the feed pump (30), a connecting line (58) to the partial suction chamber (15), a return line (61) to the fuel supply tank (20), and the overflow line (59) from the partial suction chamber (15) are connected to the reversing valve (53), and in the pumping position, the connection of the tank line (54) to the intake line (55) and of the pressure line (56) to the connecting line (58) is open, and in the deactivation position, the connection of the overflow line (59) to the intake line (55) and of the pressure line (56) to the return line (61) is open.

7. An apparatus as defined by claim 6, in which the partial suction chamber (14, 15) can be connected to one another, and the connection is controllable by means of a shutoff valve (66), wherein the shutoff valve (66) is closed during engine operation, and for shutting off the engine the reversing valve (31; 53) is located in the disconnection position and the shutoff valve (66) is open.

8. An apparatus as defined by claim 3, in which the partial suction chamber (14, 15) can be connected to one another, and the connection is controllable by means of a shutoff valve (66), wherein the shutoff valve (66) is closed during engine operation, and for shutting off the engine the reversing valve (31; 53) is located in the disconnection position and the shutoff valve (66) is open.

9. An apparatus as defined by claim 2, in which the partial suction chamber (14, 15) can be connected to one another, and the connection is controllable by means of a shutoff valve (66), wherein the shutoff valve (66) is closed during engine operation, and for shutting off the engine the reversing valve (31; 53) is located in the disconnection position and the shutoff valve (66) is open.

10. An apparatus as defined by claim 2, in which the connection of the second feed pump (21) to the partial suction chamber (14) associated with it is controllable by means of a further shutoff valve (64), wherein the shutoff valve (64) is open during engine operation and is closed for shutting off the engine, so that the partial suction chamber (14) is disconnected from the feed pump (21).

11. An apparatus as defined by claim 10, in which the second feed pump (21) has a device for internal diversion when the shutoff valve (64) is closed.

12. An apparatus as defined by claim 1, in which the reversing valve (31; 53) is embodied as a two-position multiway valve with an electromagnetic actuation.

13. An apparatus as defined by claim 12, in which the reversing valve is embodied as a 4/2-way valve (31), wherein a tank line (32) from the fuel supply tank (20), an intake line (33) to the feed pump (30), a pressure line (34) from the feed pump, and a connecting line (36) to the partial suction chamber (15) are connected to the reversing valve, and in the pumping position, the connection of the tank line (32) to the intake line (33) and of the pressure line (34) to the connecting line (36) is open, and in the deactivation position, the connection of the connecting line (36) to the intake line (33) and of the pressure line (34) to the tank line (32) is open.

14. An apparatus as defined by claim 13, in which the partial suction chamber (14, 15) can be connected to one another, and the connection is controllable by means of a shutoff valve (66), wherein the shutoff valve (66) is closed during engine operation, and for shutting off the engine the reversing valve (31; 53) is located in the disconnection position and the shutoff valve (66) is open.

15. An apparatus as defined by claim 12, in which the partial suction chamber (14, 15) can be connected to one another, and the connection is controllable by means of a shutoff valve (66), wherein the shutoff valve (66) is closed during engine operation, and for shutting off the engine the reversing valve (31; 53) is located in the disconnection position and the shutoff valve (66) is open.

16. An apparatus as defined by claim 12, in which the reversing valve is embodied as a 6/2-way valve (53), and that an overflow line (59) leads away from the partial suction chamber (15) associated with the reversing valve, wherein a tank line (54) from the fuel supply tank (20), an intake line (55) to the feed pump (30), a pressure line (56) from the feed pump (30), a connecting line (58) to the partial suction chamber (15), a return line (61) to the fuel supply tank (20), and the overflow line (59) from the partial suction chamber (15) are connected to the reversing valve (53), and in the pumping position, the connection of the tank line (54) to the intake line (55) and of the pressure line (56) to the connecting line (58) is open, and in the deactivation position, the connection of the overflow line (59) to the intake line (55) and of the pressure line (56) to the return line (61) is open.

17. An apparatus as defined by claim 16, in which the partial suction chamber (14, 15) can be connected to one another, and the connection is controllable by means of a shutoff valve (66), wherein the shutoff valve (66) is closed during engine operation, and for shutting off the engine the reversing valve (31; 53) is located in the disconnection position and the shutoff valve (66) is open.

18. An apparatus as defined by claim 1, in which the partial suction chamber (14, 15) can be connected to one another, and the connection is controllable by means of a shutoff valve (66), wherein the shutoff valve (66) is closed during engine operation, and for shutting off the engine the reversing valve (31; 53) is located in the disconnection position and the shutoff valve (66) is open.

19. An apparatus as defined by claim 18, in which the connection of the second feed pump (21) to the partial suction chamber (14) associated with it is controllable by means of a further shutoff valve (64), wherein the shutoff valve (64) is open during engine operation and is closed for shutting off the engine, so that the partial suction chamber (14) is disconnected from the feed pump (21).

20. An apparatus as defined by claim 19, in which the second feed pump (21) has a device for internal diversion when the shutoff valve (64) is closed.

21. An apparatus as defined by claim 1, in which the reversing valve (31; 53) is actuatable, by a control unit that evaluates operating parameters of the engine, as a function of the engine operating parameters.

* * * * *